US005924804A

United States Patent [19]

Hino et al.

[11] Patent Number: 5,924,804

[45] Date of Patent: Jul. 20, 1999

[54] INFORMATION RECORDING HEAD

[75] Inventors: Motohito Hino; Masaharu Ito, both of Nagoya, Japan

[73] Assignee: Brother Kogyo Kabushiki Kaisha, Nagoya, Japan

[21] Appl. No.: 09/114,299

[22] Filed: Jul. 13, 1998

[30] Foreign Application Priority Data

Jul. 15, 1997 [JP] Japan ..... 9-190124

[51] Int. Cl.[6] ..... B41J 2/00

[52] U.S. Cl. ..... 400/118.2; 400/124.01; 400/124.11; 347/40

[58] Field of Search ..... 400/118.2, 124.24, 400/124.27, 124.28, 124.01, 124.11; 347/40, 41

[56] References Cited

U.S. PATENT DOCUMENTS

| | | | |
|---|---|---|---|
| 4,010,835 | 3/1977 | Martin et al. | 400/124.27 |
| 4,408,907 | 10/1983 | Bernadis | 400/124.11 |
| 4,550,260 | 10/1985 | Ikeda | 400/118.2 X |
| 4,698,644 | 10/1987 | Drago et al. | 347/40 |
| 4,734,717 | 3/1988 | Rayfield | 347/40 |
| 4,972,270 | 11/1990 | Kurtin et al. | 347/40 X |
| 4,993,855 | 2/1991 | Adamek et al. | 400/124.27 |
| 5,642,948 | 7/1997 | Harris et al. | 400/124.28 |
| 5,835,110 | 11/1998 | Sasaki | 347/40 |
| 5,872,584 | 2/1999 | Hauck et al. | 347/86 |

FOREIGN PATENT DOCUMENTS

| | | |
|---|---|---|
| 0031421 | 7/1981 | European Pat. Off. . |
| 0 562 477 A2 | 9/1993 | European Pat. Off. . |
| 59-55761 | 3/1984 | Japan . |
| 60-72746 | 4/1985 | Japan . |
| A-6-71909 | 3/1994 | Japan . |
| A-6-71946 | 3/1994 | Japan . |
| A-6-218951 | 8/1994 | Japan . |
| 60-159066 | 8/1995 | Japan . |

OTHER PUBLICATIONS

Kope, Computer controlled printing head with several ink jets, Derwent Publication Ltd., Abstract and Figs. 1–3, Dec. 1988.

Thornhill, Rotatable Wire Matrix Printhead, IBMTechnical Disclosure Bulletin, pp. 4981–4982, vol. 24 No. 10, Mar. 1982.

*Primary Examiner*—Edgar Burr
*Assistant Examiner*—Minh H. Chau
*Attorney, Agent, or Firm*—Oliff & Berridge, PLC

[57] ABSTRACT

An information recording head of an information recording apparatus for recording information on a record medium by a dot matrix method is provided with: a holding member movable in a scanning direction relative to the record medium in the information recording apparatus; and a plurality of recording elements arranged in two rows in parallel to each other for recording the information by the dot matrix method, and held by the holding member such that each of the two rows is inclined by an inclination angle θ with respect to the scanning direction. The recording elements are arranged such that the inclination angle θ, a distance DL between the two rows and a distance DN between the adjacent recording elements in each of the two rows are expressed by predetermined expressions respectively.

5 Claims, 3 Drawing Sheets

INFORMATION RECORDING HEAD

BACKGROUND OF THE INVENTION

1. Field of the Invention

The present invention relates to an information recording head such as a printer head, which is equipped in an information recording apparatus and in which a plurality of recording elements for recording information by a dot matrix method are arranged in two rows.

2. Description of the Related Art

In an information recording apparatus for recording the information by the dot matrix method, the recording operation is performed by use of an information recording head, in which the recording elements for respectively forming the dots are arranged with constant intervals to each other on a straight line.

This kind of recording head is constructed such that the row of the recording elements is arranged in a longitudinal direction, which is perpendicular to a scanning direction of the recording head, with respect to a record medium such as a recording sheet, a recording paper or the like. Thus, the resolution of the dot matrix (i.e., the minimum interval between the adjacent dots) formed by the recording head, and especially the lateral resolution along the scanning direction is determined by the relative moving speed of the recording head with respect to the recording medium and the interval of the discharge of the ink. On the other hand, the longitudinal resolution along the longitudinal direction perpendicular to the scanning direction is fixed by the interval of the arrangement in the longitudinal direction of the recording head constructing the recording head. Therefore, in order to realize a recording operation in which the longitudinal resolution is variable, it is necessary to prepare a plurality of recording heads, whose intervals of the arrangements in the longitudinal directions of the recording elements are different from each other.

By the way, because of the size of the recording element and the restriction on a production or process of the recording element (e.g., the easiness of the process, the strength achieved by the process), there may be raised a case where the distance (interval) between the adjacent recording elements cannot be reduced to be less than a predetermined value, i.e., a case where the longitudinal resolution cannot be improved.

Thus, there is a method of reducing the interval between the adjacent dots in the longitudinal direction by arranging the recording head such that the row of the recording elements is inclined with respect to the scanning direction by an angle θ. Namely, assuming that the interval between the adjacent recording elements is x and the inclination angle is θ, the interval of the dots formed by this row of the recording elements becomes x Sin θ, so that the interval of the dots becomes its maximum when the inclination angle θ is 90 [deg] and the interval of the dots decreases as the inclination angle θ approaches 0 [deg]. In this structure, even in case of a single recording head, by adjusting the inclination angle θ of the row of the recording elements with respect to the scanning direction, it is possible to set the longitudinal resolution voluntarily. However, in this structure, in case that the range to form the dots (i.e. the longitudinal width of the dots) by one scanning operation is set in advance, since the more number of the recording elements should be arranged in one row as the longitudinal resolution is to be increase, there is a problem that the size of the recording head becomes significantly large.

As a countermeasure to this problem, there is a recording head in which the recording elements are arranged in two rows in parallel to each other. In this recording head, since the recording elements are arranged such that the dots formed by the recording elements in both of the two rows are arranged at equidistant intervals in the longitudinal direction alternatively to each other. Thus, as compared with the case that the recording elements are arranged in one row, the length in the row direction can be reduced to be about half.

By the way, as the resolution required in the recording apparatus becomes higher, the more accurate designing and processing are required for the production of the recording head. Thus, since the time and trouble are required for the development and the manufacture of such a recording head, it is desired to commonly use the recording head in cases where the resolutions are different from each other.

However, in case of the recording head having the two rows of the recording elements, it is not possible to voluntarily incline the row of the recording elements with respect to the scanning direction as in the case of the recording head having just one row of the recording elements. Thus, since the different recording heads should be manufactured for each longitudinal resolution to be realized, the trouble and cost cannot be reduced in this case of the recording head having the two rows, which is a problem.

That is, in case of the recording head having one row of the recording elements, if the row of the recording elements is inclined with respect to the scanning direction, the intervals in the longitudinal direction of the dots formed by the recording elements are shortened homogeneously. On the contrary to this, in case of the recording head having the two rows, if the two rows are inclined with respect to the scanning direction, the intervals in the longitudinal direction of the dots formed by the recording elements become heterogeneous. Consequently, the different recording heads should be prepared for each longitudinal resolution to be realized.

SUMMARY OF THE INVENTION

The present invention is proposed in view of the above mentioned problems. It is therefore an object of the present invention to provide an information recording head, which can form dot matrixes in plural kinds having resolutions in a longitudinal direction different from each other while having two rows of recording elements.

The above object of the present invention can be achieved by an information recording head of an information recording apparatus for recording information on a record medium by a dot matrix method. The information recording head is provided with: a holding member movable in a scanning direction relative to the record medium in the information recording apparatus; and a plurality of recording elements arranged in two rows in parallel to each other for recording the information by the dot matrix method, and held by the holding member such that each of the two rows is inclined by an inclination angle θ with respect to the scanning direction. The recording elements are arranged such that:

(i) the inclination angle θ is expressed by a following expression (1), $$\theta=\tan^{-1}(y/x) \tag{1}$$

wherein x represents a distance between an intermediate point, which is between adjacent recording elements in a direction parallel to each of the two rows, and each of the adjacent recording elements, which is adjacent to the intermediate point, along the scanning direction, and y represents a distance between the intermediate point and each of the adjacent recording elements along a direction perpendicular to the scanning direction;

(ii) a distance DL between the two rows is expressed by a following expression (2), $$DL=(m^2x^2+4n^2y^2)^{1/2} \quad (2)$$

wherein m represents an integer, and n represents an integer; and (iii) a distance DN between the adjacent recording elements in each of the two rows is expressed by a following expression (3).

$$DN=2(x^2+y^2)^{1/2} \quad (3)$$

According to the present invention, when the inclination angle θ is a predetermined value other than 90 degrees, a point between the adjacent recording elements in one of the two rows corresponds to the recording element in the other of the two rows in the direction perpendicular to the scanning direction, so that it is possible to record by the dot matrix method in which the dot pitch is y in the direction perpendicular to the scanning direction and the dot pitch is x/b (b: positive integer) in the scanning direction. When the inclination angle θ is 90 degrees, a point between the adjacent recording elements in one of the two rows corresponds to the recording element in the other of the two rows in the direction perpendicular to the scanning direction, so that the dot pitch is DL/2 in the direction perpendicular to the scanning direction and the dot pitch is DN/a (a: positive integer) in the scanning direction. Thus, even if the inclination angle θ equals to 90 degrees, the information recording head can be appropriately used. Incidentally, a and b can be freely set by adjusting the relative moving velocity of the information recording head with respect to the record medium, and the driving interval of the recording elements.

In one aspect of the information recording head of the present invention, the holding member holds the recording elements at the inclination angle θ of either one of 90 degrees and a predetermined angle other than the 90 degrees, so as to realize different longitudinal resolutions respectively.

Accord to this aspect, the information recording head can be employed commonly for two kinds of the information recording apparatuses in which the longitudinal resolutions thereof are different from each other. In other words, in case that a plurality of recording head whose longitudinal resolutions (i.e. the resolution in the direction perpendicular to the scanning direction) are different from each other are to be produced, the number of the different kinds of the recording heads to be produced can be reduced to be about ½. Accordingly, it is possible to drastically reduce the trouble and cost required for the designing of the information recording heads.

In another aspect of the information recording head of the present invention, each of the recording elements comprises a nozzle for discharging ink.

According to this aspect, the dot matrix type recording method can be executed by use of the nozzle for each of the recording elements.

In this aspect, each of the recording elements may be further provided with an actuator for change an capacity of an ink flowing path for each nozzle. Thus, by the action of the actuator, the ink can be appropriately discharged from the nozzle for each of the recording elements.

In another aspect of the information recording head of the present invention, the holding member is fixed on a head holder of the information recording apparatus movably in the scanning direction.

According to this aspect, since the holding member is fixed on the head holder, it is easy to change and fix the inclination angle θ by changing the fixing angle of the holding member on the head holder.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Preferred embodiments for the present invention are explained with reference to the drawings.

Figure 1A:
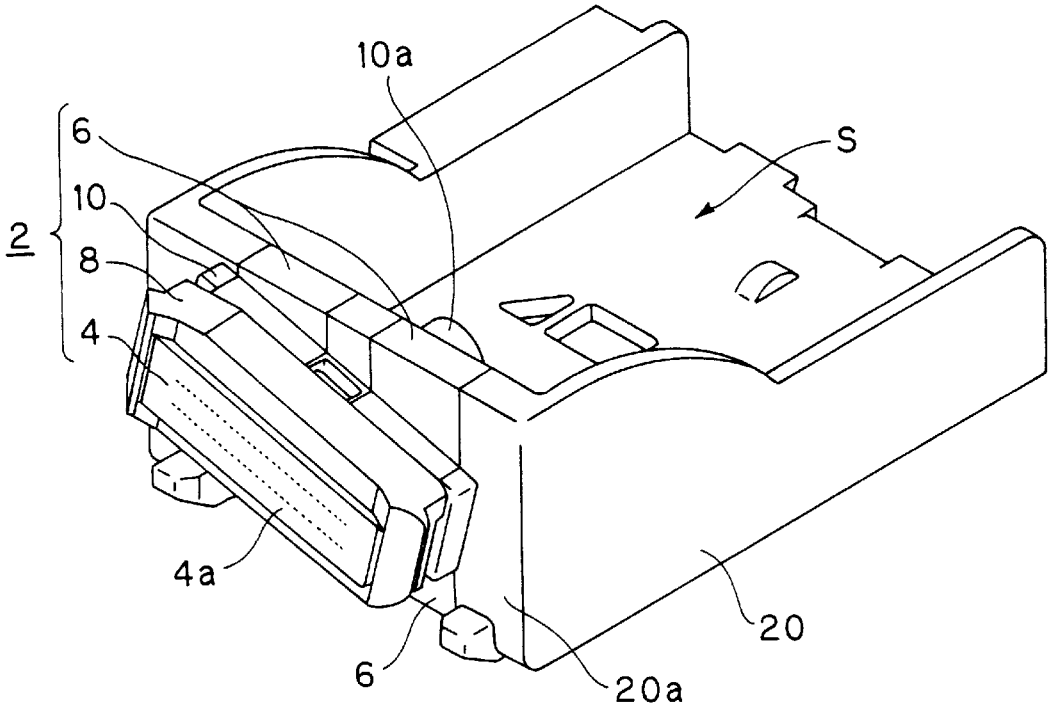
FIG. 1A is a schematic perspective view of a recording head of an embodiment of the present invention in one state.

FIG. 1A is a schematic perspective view of a recording head of ink jet type as an embodiment of the present invention, in a state that the recording head is fixed to a head holder and inclined with respect to the scanning direction of the recording head.

In FIG. 1A, a recording head 2 is fixed on an opposing surface 20*a* of an head holder 20, which is relatively movable with respect to a record medium such as a record sheet, a record paper or the like (not shown). The head holder 20 to which the recording head is fixed has a wall portion prescribing a storage space S for accommodating an ink cartridge (not shown) for supplying ink to the recording head 2.

The recording head 2 is provided with an actuator 4, a flexible substrate (FPC) 6, a holding member 8 and a manifold 10.

In the actuator 4, a plurality of nozzles for discharging the ink are formed. The actuator 4 changes the capacity of an ink flowing path (which is referred to as an "ink channel", hereinafter) formed for each nozzle, by an action of a piezoelectric element, so as to discharge the compressed ink in the ink channel due to the capacity change through the nozzle to the external. Such an actuator 4 can be constructed in a known manner.

The flexible substrate 6 for supplying a control signal is soldered on a control electrode (not shown) for controlling the piezoelectric element installed on both side surfaces along the longitudinal direction of an ink discharging surface 4*a* of the actuator 4. The holding member 8 covers the circumference side surface of the ink discharging surface 4*a* so as to protect the actuator 4 and adheres the FPC 6 to the control electrode. The manifold 10 is adhered on the opposite side of the ink discharging surface 4*a* of the actuator 4, and forms the space for distributing the ink supplied through the ink inlet port 10*a*, which is protruded to the storage space S, to each channel of the actuator 4.

In the recording head 2 constructed in this manner, the ink, which is distributed to each channel of the actuator 4 through the ink inlet port 10*a* and the manifold 10 from the ink cartridge accommodated in the head holder 20, is discharged from the nozzle in accordance with the control signal applied to the control electrode through the FPC 6.

Figure 2:
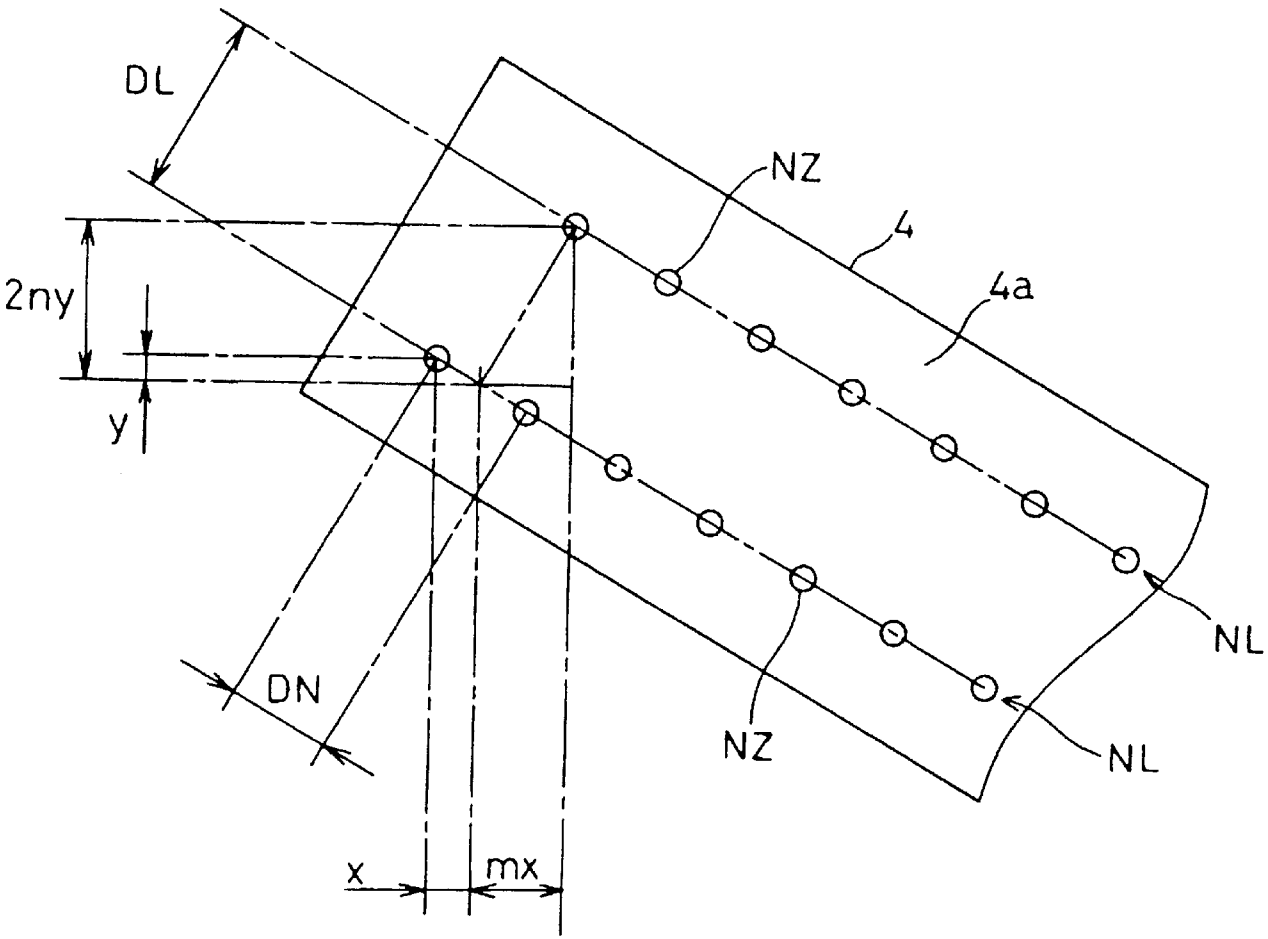
FIG. 2 is a diagram showing an arrangement of nozzles of the recording head of the embodiment.

Here, FIG. 2 is a diagram showing an arrangement of the nozzles formed in the actuator 4.

As shown in FIG. 2, on the ink discharging surface 4*a* of the actuator 4, two nozzle rows NL, each of which consists of a large number of nozzles NZ on a straight line, are provided in parallel to each other.

In the present embodiment, each of the nozzle rows NL consists of 64 nozzles NZ, so that 128 nozzles NZ are provided in total in the actuator 4. In FIG. 2 (and FIG. 3A and FIG. 3B as well), however, for the sake of simplicity of the drawing, just 7 nozzles NZ for each nozzle row NL (i.e., 14 nozzles in total) are illustrated.

In the present embodiment, the distance DN between the adjacent nozzles NZ in each nozzle row NL is 0.3175 mm (=80 dpi), and the distance DL between the nozzle rows NL is 0.55 mm (=46.2 dpi).

Figure 3A:
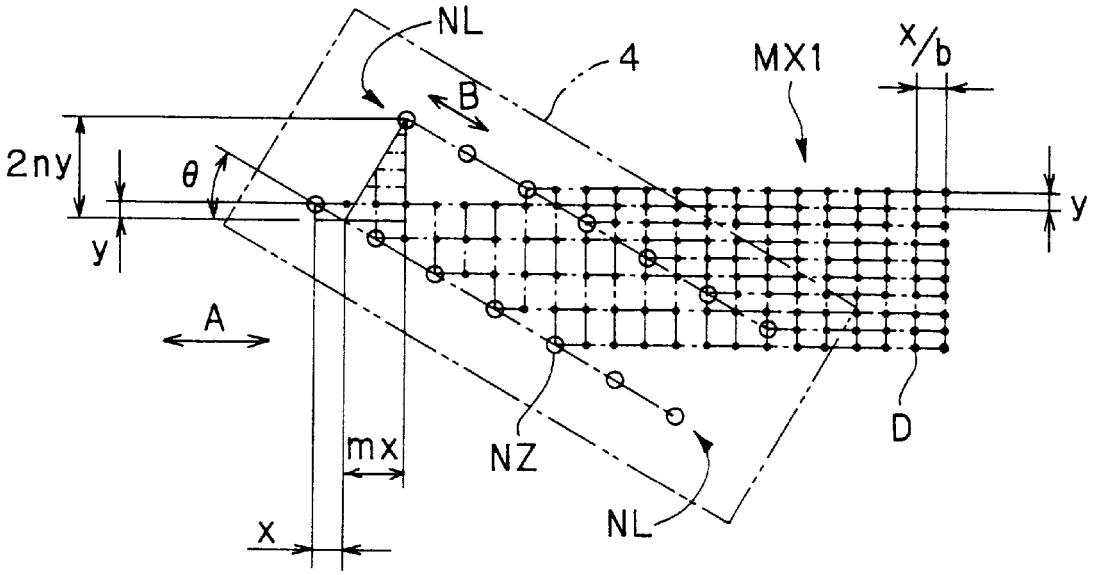
FIG. 3A is a diagram showing a dot matrix formed by the recording head of the embodiment in one state.
Figure 3B:
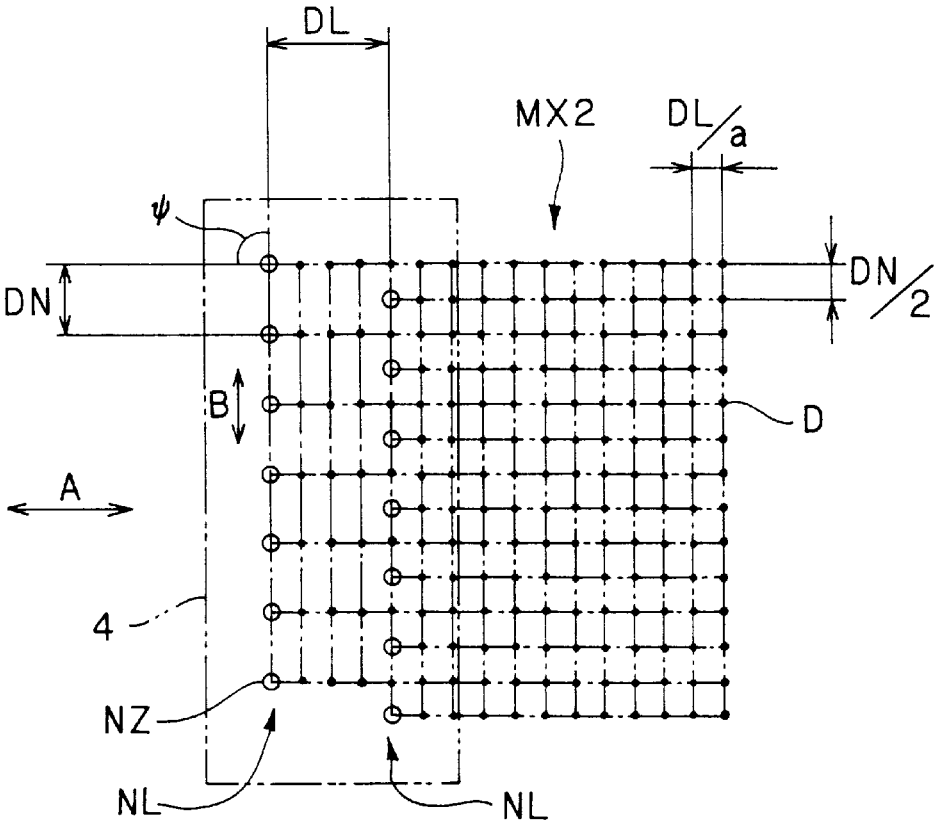
FIG. 3B is a diagram showing a dot matrix formed by the recording head of the embodiment in another state.

The recording head 2 provided with the actuator 4 having such a nozzle arrangement is fixed on the head holder 20 such that, as shown in FIG. 3A and FIG. 3B, the angle of a row direction B of the nozzle row NL (it is referred to as a "fixing angle" hereinafter) with respect to a direction A in which the recording head 2 is moved by the carriage (i.e. the scanning direction) be either one of a first angle θ (e.g., 30 [deg] in the present embodiment) and a second angle ϕ (e.g., 90 [deg] in the present embodiment).

Incidentally, each of the above mentioned parameters θ, DN and DL are the values which can be calculated according to the aforementioned expressions (1) to (3) with x=0.1375 [mm], y=0.0794[mm], m=2 and n=3.

In case that the recording head 2 is fixed with the first angle θ (=30 [deg]) as shown in FIG. 1A, the nozzle NZ in one of the two nozzle rows NL is positioned at a center between the adjacent nozzles NZ in another of the two nozzle rows NL as for both of the scanning direction A and its perpendicular direction as shown in FIG. 3A. Thus, the dot interval x/b (i.e., the lateral resolution) along the scanning direction A of the dot matrix MX1 formed by the recording head 2 is about 0.1375 mm (=184.8 dpi) while the dot interval y in the longitudinal direction which is perpendicular to the scanning direction (i.e., the longitudinal resolution) is about 0.0794 mm (=320 dpi). These figures are obtained on the assumption that the relative speed of the carriage with respect to the recording sheet and the discharging interval of the ink are set such that the recording head 2 forms one dot (b=1) while the recording head 2 relatively moves with respect to the recording sheet for just distance x along the scanning direction A.

Figure 1B:
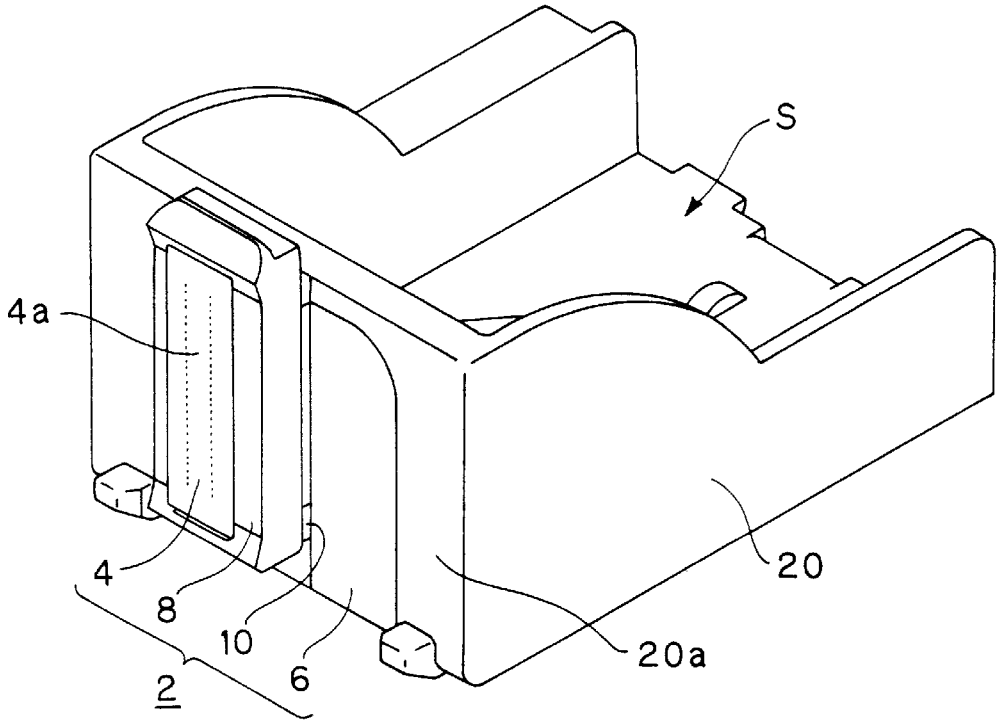
FIG. 1B is a schematic perspective view of the recording head of the embodiment in another state.

On the other hand, in case that the recording head 2 is fixed with the second angle ϕ (=90 [deg]) as shown in FIG. 1B, the nozzle NZ in one of the two nozzle rows NL is positioned at a center between the adjacent nozzlesndicular to the scanning direction A as shown in FIG. 3B. Thus, th NZ in another of the two nozzle rows NL as for a direction perpee dot interval DL/a (i.e., the lateral resolution) along the scanning direction A of the dot matrix MX2 formed by the recording head 2 is about 0.1374 mm (=184.8 dpi) while the dot interval DN/2 in the longitudinal direction which is perpendicular to the scanning direction A (i.e., the longitudinal resolution) is about 0.1588 mm (=160 dpi). These figures are obtained on the assumption that the relative speed of the carriage with respect to the recording sheet and the discharging interval of the ink are set such that the recording head 2 forms four dot (a=4) while the recording head 2 relatively moves with respect to the recording sheet for just distance DL along the scanning direction A.

As explained above, according to the recording head 2 of ink jet type of the present embodiment, by selecting one of the first angle θ and the second angle ϕ as the fixing angle to the head holder 20, it is possible to perform recording by two different kinds of resolutions i.e., 320 dpi or 160 dpi by use of just one recording head 2.

As a result, it is possible to cope with two kinds of longitudinal resolutions by use of just one recording head 2. Since it is not necessary to prepare the recording head 2 for each of the different longitudinal resolutions, the trouble and cost required for designing the information recording head can be drastically reduced.

In the above described embodiment, although just one example of the set of the parameters x, y, m, n, θ, DN, and DL to prescribe the arrangement of the nozzles NZ has been explained, the set of the parameters is not limited to this. Instead, as long as it satisfies the expressions (1) to (3), any set of the parameters can be employed.

In the above embodiment, although the arrangement of the nozzles NZ is set such that the longitudinal resolution is switched to be double, the arrangement of the nozzles NZ may be set such that the longitudinal resolution can be switched by a desirable magnification, by designing it with the condition of switching the ratio of y and DN/2 to a desirable magnification in addition to the expressions (1) to (3). Further, in the above embodiment, although the actuator 4 changes the capacity of the ink flowing path formed for each of the nozzles by virtue of the piezoelectric element, it is possible to cause the capacity change by other means. For example, the type of discharging the ink by the pressure change generated when the ink is evaporated promptly by a heater installed in the ink flowing path may be employed.

Furthermore, in the above embodiment, although the example has been explained in which the present invention is applied to the recording head of ink jet type, it is not limited to this. For example, the present invention can be applied to any recording head for recording by means of the dot matrix, such as a thermal type recording head for performing a thermal sensitive recording operation, the impact type recording head using a wire, and so on.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No.09-190124 filed on Jul. 15, 1997 including the specification, claims, drawings and summary is incorporated herein by reference in its entirety.

What is claimed is:

1. Information recording head of an information recording apparatus for recording information on a record medium by a dot matrix method, said information recording head comprising:

a holding member movable in a scanning direction relative to the record medium in said information recording apparatus; and a plurality of recording elements arranged in two rows in parallel to each other for recording the information by the dot matrix method, and held by said holding member such that each of the two rows is inclined by an inclination angle θ with respect to the scanning direction, said recording elements being arranged such that:

(i) the inclination angle θ is expressed by a following expression (1), $$\theta=\tan^{-1}(y/x) \quad (1)$$

wherein x represents a distance between an intermediate point, which is between adjacent recording elements in a direction parallel to each of the two rows, and each of the adjacent recording elements, which is adjacent to the intermediate point, along the scanning direction, and y represents a distance between the intermediate point and each of the adjacent recording elements along a direction perpendicular to the scanning direction;

(ii) a distance DL between the two rows is expressed by a following expression (2), $$DL=(m^2x^2+4n^2y^2)^{1/2} \quad (2)$$

wherein m represents an integer, and n represents an integer; and (iii) a distance DN between the adjacent recording elements in each of the two rows is expressed by a following expression (3), $$DN=2(x^2+y^2)^{1/2} \quad (3).$$

2. An information recording head according to claim 1, wherein said holding member holds said recording elements at the inclination angle θ of either one of 90 degrees and a predetermined angle other than the 90 degrees, so as to realize different resolutions respectively.

3. An information recording head according to claim 1, wherein each of said recording elements comprises a nozzle for discharging ink.

4. An information recording head according to claim 3, wherein each of said recording elements further comprises an actuator for change in capacity of an ink flowing path for each nozzle.

5. An information recording head according to claim 1, wherein said holding member is fixed on a head holder of said information recording apparatus movably in the scanning direction.

* * * * *